US005883719A

United States Patent [19]

Coope

[11] Patent Number: 5,883,719

[45] Date of Patent: Mar. 16, 1999

[54] DISPLACEMENT MEASUREMENT APPARATUS AND METHOD

[75] Inventor: Nicholas Coope, Clwyd, Wales

[73] Assignee: Pilkington PE Limited, Wales, United Kingdom

[21] Appl. No.: 894,502

[22] PCT Filed: Feb. 21, 1996

[86] PCT No.: PCT/GB96/00378

§ 371 Date: Oct. 17, 1997

§ 102(e) Date: Oct. 17, 1997

[87] PCT Pub. No.: WO96/26410

PCT Pub. Date: Aug. 29, 1996

[30] Foreign Application Priority Data

Feb. 22, 1995 [GB] United Kingdom ..... 950348506

[51] Int. Cl.[6] ..... G01B 11/26; G01B 11/14

[52] U.S. Cl. ..... 356/375; 356/152.1

[58] Field of Search ..... 356/375, 247, 356/251–254, 138, 152, 153, 154, 147, 152.2, 139.03; 33/286, 233–234

[56] References Cited

U.S. PATENT DOCUMENTS

| | | | |
|---|---|---|---|
| 3,684,383 | 8/1972 | Johansson | 356/154 |
| 3,989,384 | 11/1976 | Friedman | 356/152 |
| 4,142,799 | 3/1979 | Barton | 356/153 |
| 4,383,474 | 5/1983 | Paurus et al. | 89/41 ME |
| 5,513,000 | 4/1996 | Smith et al. | 356/152.2 |

FOREIGN PATENT DOCUMENTS

| | | |
|---|---|---|
| 0 034 441 | 8/1981 | European Pat. Off. . |
| 2 504 668 | 4/1981 | France . |
| 2 040 225 | 2/1972 | Germany . |
| 1 354 597 | 5/1974 | United Kingdom . |
| 2 138 926 | 10/1984 | United Kingdom . |

*Primary Examiner*—Frank G. Font
*Assistant Examiner*—Michael P. Stafira
*Attorney, Agent, or Firm*—Bell Seltzer Intellectual Property Law Group of Alston & Bird LLP

[57] ABSTRACT

The displacement of a first object (6) relative to a second object (28) is measured by differential measurements from a photodetector (17) and an associated evaluation device (18). The photodetector (17) receives a measurement beam of radiation from a source (9) via a reflector (5) secured to object (6), and a reference beam of radiation from a source (10) via a reflector (26) secured to object (28). Sources (9, 10) are closely adjacent and in the focal plane of a collimating lens (13) through which both beams pass. Both beams are focused onto the detector (17) by a focusing lens (21). Because both beams pass through lenses (13, 21) movements thereof do not affect the displacement measurement. The remaining optical components which are used for beam steering and guidance are comparatively stable and so do not affect the displacement measurement

4 Claims, 3 Drawing Sheets

DISPLACEMENT MEASUREMENT APPARATUS AND METHOD

FIELD OF THE INVENTION

The present invention relates to an apparatus and method for measuring the relative displacement of an object with respect to a reference position.

RELATED BACKGROUND ART

In many areas it is extremely desirable to be able to precisely measure a small displacement of an object relative to some reference position. One area in which this technique is particularly applicable is in determining the relative movement of parts of large engineering structures, for example, bridges and their supports. It is often the case that the bulk of the measurement apparatus cannot be mounted on a surface which can be guaranteed to be fixed with respect to any of the moving parts of interest.

A second area of application is in the determination of the bending of a gun barrel, and in particular the gun barrel of a tank, in order to ensure highly accurate firing of the gun. Bending of a gun barrel can be caused by a number of factors including thermal effects resulting from firing of the gun and/or weather conditions, backlash in the gun mounting following each firing, and vibration due to tank motion. Whilst it is possible to reduce the effects of barrel bending by physically stabilising the barrel, it is not possible to completely eliminate the problem. Efforts have therefore been made to provide systems for determining the extent of barrel bending so that the degree of bending can be compensated for when the gun is being aimed.

There is described in GB 1,587,714 apparatus for correcting sighting errors in a tank gun barrel arising from barrel bending. The system comprises a light source and an adjacent detector, both fixed to the breech end of the gun barrel, or to the tank turret, and a mirror fixed at or near the muzzle end of the gun barrel. A light beam from the light source is directed onto the mirror which reflects the light beam back to the light detector. Any angular displacement of the barrel muzzle relative to the breech end of the barrel causes the returning light beam to be moved across, or off, the light detector. The extent of any angular displacement can therefore be estimated by monitoring the output of the light detector. Other systems are known which project a collimated beam of light from the source to the muzzle mirror and thence back to the detector.

A problem with systems such as that described in GB 1,587,714, and similar systems commonly known as muzzle reference systems (MRS), is that beam deflection can occur due to factors other than displacement of the barrel muzzle. For example, movement of optical components in the transmitting or receiving optical systems can cause such beam deflection. In addition, non-linearity in the light detector itself, or in other components of the detection circuitry, can erroneously indicate barrel displacement. These errors are inevitably translated into misalignment of the gun barrel when the barrel is being aimed. Significant targeting errors can arise from bending of the gun barrel by even a few tens of micro-radians and the known muzzle reference systems are not capable of resolving bending measurements with this degree of accuracy.

It is an object of the present invention to overcome or at least mitigate certain of the disadvantages of known apparatus and methods for determining relative object displacement.

In particular, it is an object of the present invention to provide an automatic muzzle reference sensor (AMRS) system for measuring the angular displacement of a gun barrel muzzle with respect to the breech end of the barrel whilst substantially eliminating errors resulting from transmitting and receiving optics and circuitry.

SUMMARY OF THE INVENTION

According to a first aspect of the present invention there is provided apparatus for measuring the displacement of a first object relative to a second object, the apparatus comprising electromagnetic radiation source and detection means, first and second reflection means fixed to the first and second objects respectively, radiation guide means forming first and second channels for directing radiation from the source means respectively onto the first and second reflection means and for directing the respective reflected beams onto the detection means, the detection means comprising a detection surface arranged to provide signals indicative of the positions on the detection surface where the reflected beams of the first and second channels are incident, and evaluation means coupled to receive said signals and by differential measurement to calculate therefrom a measure of the displacement of the first object relative to the second object.

The provision of a differential measurement between the first and second channels allows for the compensation of offset errors arising in components common to the first and second channels, for example the detection means.

The first and second reflection means referred to above may be any suitable means for redirecting radiation incident thereon, eg mirrors or prism arrangements.

A particularly suitable form of detection surface is a lateral effect photodiode arranged to determine the position of the centroid of an incident radiation beam. This type of detection surface will generally require that the source means be arranged to sequentially generate first and second beams for direction to the first and second reflection means respectively such that the detector surface may distinguish between them and provide respective sequential signals to the evaluation means. In this case the evaluation means comprises a calculation or arithmetic unit and a data storage unit.

Another suitable form of detection surface is provided by a TV camera which may be of the vidicon or CCD type and which records the position of the or each incident light beam. With this type of detection surface the source means may simultaneously generate the first and second beams if their incidences on the TV camera are individually distinguishable (eg by physical separation or by shape). The evaluation means in this case comprises a storage unit and an automatic classification and tracking system together with a calculation or arithmetic unit.

Preferably, the source means comprise a plurality of discrete sources which are fixed relative to each other. The detector means may also comprise a plurality of discrete detection surfaces which are fixed relative to each other.

Preferably, the first beam and the second beam pass through several common optical components. For example, where the guide means for directing the first beam towards the first reflection means comprises a collimating lens, the second beam is also directed through this collimating lens. Similarly, where the first beam is focused onto the detection surface by a lens, the second beam is also arranged to pass through this lens. This arrangement enables variations arising from the movement of the collimating and focusing lenses which are common optical components, to be compensated for. Preferably, components which are not common between the two channels are inherently stable. For example, a corner-cube may be used to reverse the direction of a beam, the cube being inherently substantially insensitive to its precise orientation.

Preferably, the radiation source means is arranged to generate a third beam of electromagnetic radiation, the third beam being directed to the detection means by the same guide means used to direct the second beam, the second and third beams being arranged to be incident upon the detection surface at nominally fixed, spaced apart locations whereby a change in the measured separation of the second and third beams at the detection surface enables the calculation of relative displacement to be compensated for variations from an initial value of the system's sensitivity (gain).

Preferably, the detection means is capable of measuring displacements in two substantially orthogonal axes, contained within the plane of the detection surface, and the evaluation means is able to resolve the deflection or displacement of the first object relative to the second object into any of a number of co-ordinate systems.

The detection surface may, for example, be a two axis continuous sensing super-linear lateral effect photodiode.

In a preferred embodiment of the present invention, the source means of electromagnetic radiation comprises discrete optical fibres coupled to separate laser diodes which can be energised in turn to permit a detection surface, which responds only to the centroid of the total incident radiation, to discriminate between them. Mechanical screening is provided to prevent radiation from any fibre from traversing an incorrect channel. A collimating lens for the fibres, a focusing lens and a two-axis continuous position sensitive detector are common to all channels. The first channel which comprises the first reflection means additionally comprises a pair of steering wedges and a focus adjustment lens in the transmission path and a second pair of steering wedges and focus adjustment lens in the reception path. The first reflection means comprises a plane mirror. The second channel which comprises the second reflection means additionally comprises a truncated corner cube in the transmission path, a second truncated corner cube in the reception path, and a 'W' prism which forms the second reflection means.

According to a second aspect of the present invention there is provided apparatus for measuring the displacements of first and second objects relative to a datum of the apparatus, the apparatus comprising a source of electromagnetic radiation and an electromagnetic radiation detection means, both means being fixed relative to said datum, wherein displacement of a beam of radiation from the source across the detection means is measurable by the detection means, an evaluation means coupled to the detection means for calculating the true displacement relative to the apparatus datum of the source beam based on the said measured displacement, the apparatus also comprising a main channel having a first reflection means arranged to be fixed relative to the first object, means for directing a main beam of electromagnetic radiation from the source onto the first reflecting means, the first reflection means being arranged to reflect radiation from the incident main beam onto the detection means, wherein displacement of the first object results in a corresponding displacement of the reflected main beam across the detection means, means for causing the detection means to respond only to radiation from the source traversing the main channel, the apparatus further comprising a reference channel having a second reflection means arranged to be fixed relative to the second object, means for directing a reference beam of electromagnetic radiation from the source onto the second reflection means, the second reflection means being arranged to reflect radiation from the incident reference beam onto the detection means, wherein displacement of the second object results in a corresponding displacement of the reflected reference beam across the detection means, means for causing the detection means to respond only to radiation from the source traversing the reference channel, the calculation means being further arranged to provide an output indicative of displacement difference between the first and second objects.

According to the third aspect of the present invention there is provided an automatic muzzle reference sensor system comprising apparatus according to the above first or second aspect of the invention, wherein the first object is at or near the muzzle of a gun barrel and the second object and is at or near the breech end of the gun barrel.

According to a fourth aspect of the present invention there is provided a method of measuring the displacement of a first object relative to a second object, the method comprising directing a beam of electromagnetic radiation from a source towards a reflection means fixed relative to the first object, detecting displacement of the first reflected beam by way of a detector, generating a second beam of electromagnetic radiation and directing it towards a second reflection means fixed relative to the second object, detecting displacement of the second reflected beam by way of said detector, and calculating the relative displacement of the first and second objects from the two detected beam displacements.

The above method by virtue of differential measurement enables the estimation of said relative displacement to be compensated for errors which arise equally in both of the detected beam displacements.

For a better understanding of the present invention and in order to show how the same may be carried into effect reference will now be made, by way of example, to the accompanying drawings.

DETAILED DESCRIPTION OF THE PREFERRED EMBODIMENTS

Figure 1:
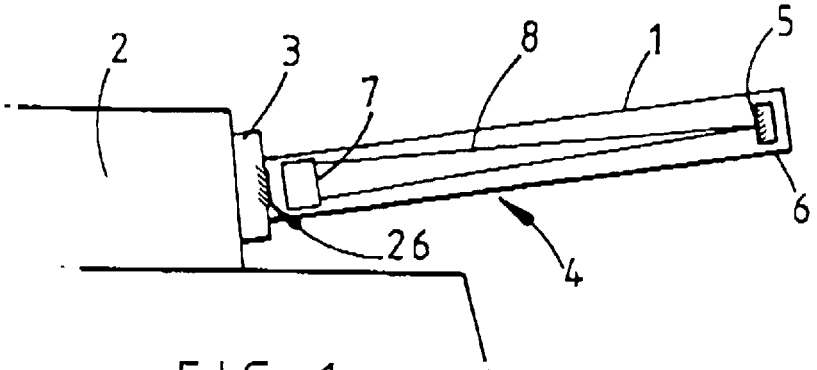
FIG. 1 shows an automatic muzzle reference sensor system attached to the gun barrel of a tank.

There is shown in FIG. 1 a gun barrel 1 which extends from the turret 2 of a tank. The barrel is able to recoil through a protective mantlet 3 which otherwise elevates and depresses in harmony with the gun barrel. The tank is provided with an automatic muzzle reference sensor (AMRS) system 4 which is arranged to provide an accurate indication of muzzle deflection, due to bending of the barrel, to an aiming computer (not shown in FIG. 1) onboard the tank. The AMRS system comprises a first reflection means in the form of a mirror 5 which is rigidly attached to the muzzle 6 at the end of the gun barrel 1. At the opposite end of the gun barrel and rigidly fixed to the gun mantlet 3 there is a second reflection means in the form of a prism 26. A housing 7 containing an optical radiation source, an adjacent detector arrangement and transmit and receive optics is provided at the breech end, conveniently adjacent the mantlet 3. As with conventional AMRS systems, a beam of light 8 generated by the light source is directed along the length of the gun barrel so as to be incident on the mirror S and to be reflected thereby back towards the detector arrangement. Light incident on the detector arrangement causes an electrical output signal to be produced which varies as the reflected beam moves across the detection surface, for example due to barrel bending.

In addition, the AMRS system 4 in accordance with the present invention is provided with an internal reference channel to enable data transmitted to the aiming computer to be compensated for changes in the detector output which arise from factors other than barrel bending, for example movement of common components of the transmission and/or receiving optics. The use of such a reference channel has previously not been considered.

Figure 2:
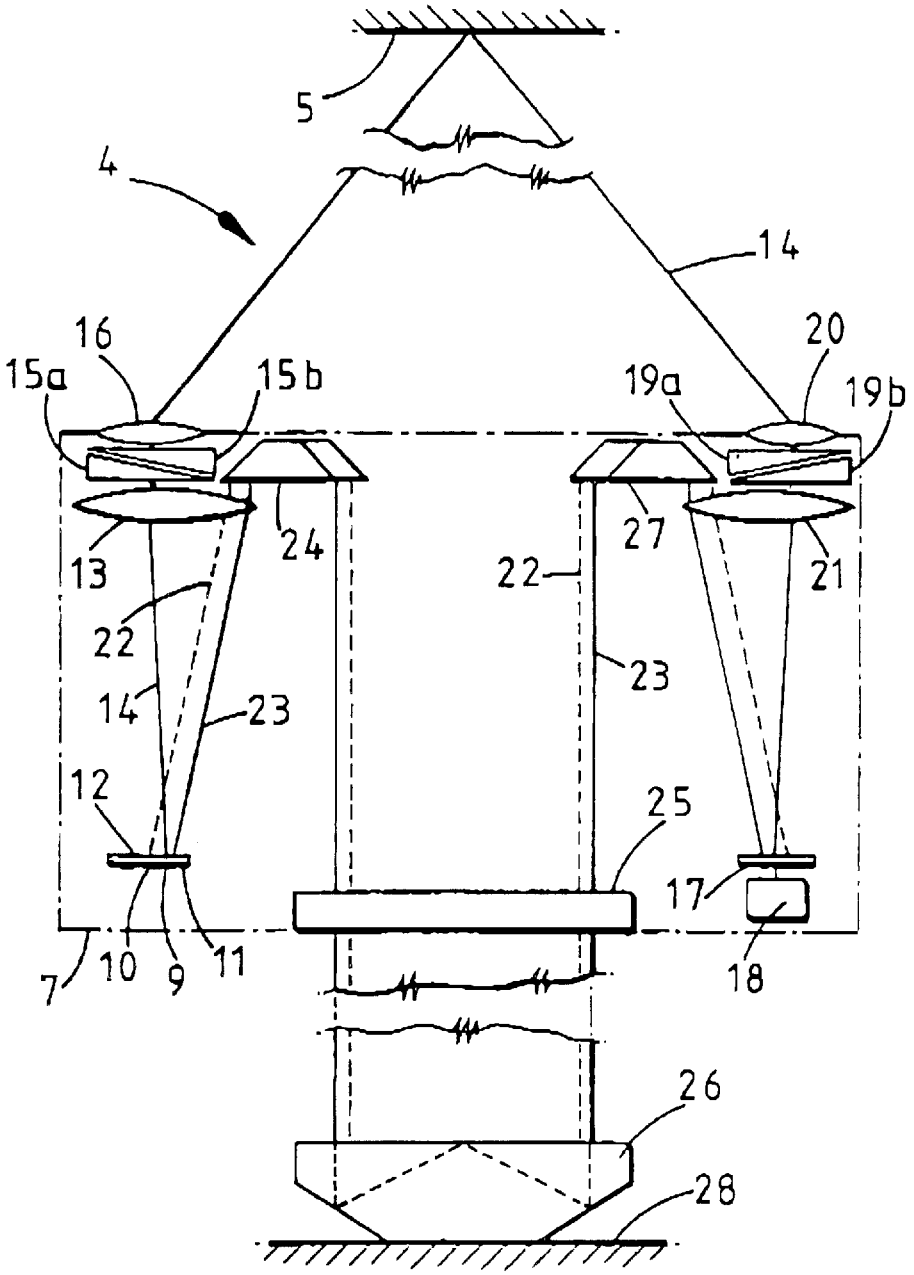
FIG. 2 shows in detail the optical components of the automatic muzzle reference system of FIG. 1.

FIG. 2 shows in more detail the optical components which comprise the AMRS system 4 (the diagram is compressed in the longitudinal direction for clarity) and illustrates a main and reference measurement channel. The active components of the system are rigidly secured within the housing 7 to sensibly minimise errors arising from vibration and relative movement.

The housing 7 contains three light sources 9,10,11, secured to a baseplate 12 in the focal plane of a common collimating lens 13, and which are provided by respective optical fibres and associated laser diodes. At any one time, only a single one of the light sources is illuminated by its laser as will be described hereinafter. Mechanical baffles (not shown) are provided to prevent light from the main channel source 9 reaching the detector arrangement via the reference channel path, and light from the reference channel sources 10,11 reaching the detector arrangement via the main channel path.

A first of the light sources 9 is arranged to provide a main light beam 14 which is directed by transmitting optics so as to be incident on the mirror 5, which preferably is a plane mirror, mounted at the muzzle end of the barrel. The main beam is directed by the collimating lens 13, a pair of adjustable steering wedges 15*a*,15*b*, and a focus adjustment lens 16. The beam is reflected by the muzzle mounted mirror 5 and is directed by receiving optics back towards the breech end of the barrel so as to be incident upon the detector arrangement which comprises a photodetector 17 connected to an evaluation means 18.

The reflected beam 14 passes through a second focus adjustment lens 20, a second pair of steering wedges 19*a*, 19*b*, and a lens 21 which focuses the beam to a fine spot, which is an image of the light source 9, on the surface of the photodetector 17. It will be appreciated from FIGS. 1 and 2 that any displacement of the mirror 5 will cause the spot focused onto the photodetector 17 to move across the photodetector surface and, if the angular displacement of the mirror 5 is great enough, to move off the surface of the photodetector 17. It will also be appreciated that, if the mirror 5 is a plane mirror, the focus adjustment lenses 16, 20 may not be required and the focused spot will move across the photodetector surface in response only to angular displacement of the mirror 5.

The second and third light sources 10,11 provide a pair or reference beams 22,23 which are directed to pass through an edge region of the collimating lens 13 of the transmitting optics. A corner cube 24 is situated behind the edge of the collimating lens 13 and is arranged to receive the two reference beams transmitted through the collimating lens 13 and to reflect them back towards the breech end of the housing 7. These reflected beams 22,23 pass through a window 25 in the housing 7 and are incident and are incident upon the prism 26 which preferably is a 'W' prism so that the reference beams undergo three reflections and transverse displacement before being directed once more back towards the muzzle end to a truncated corner cube 27. This second corner cube 27 reflects the two reference beams 22,23 once more so that they are directed to pass through an edge region of the focusing lens 21 before being incident upon the surface of the photodetector 17 and forming respective images of the light sources 10,11. The 'W' prism 26 is rigidly secured to and in close contact with a mounting interface 28 of the gun mantlet 3.

The combination of the two corner cubes 24,27, which, for example, may be of the solid glass truncated type and the 'W' prism 26 provide the necessary transverse shift of the reference beams 22,23 whilst allowing the beams to pass through the collimating lens 13 and the focusing lens 21 of the transmitting and receiving optics respectively. In addition, the corner cubes 24, 27 and the prism 26 are inherently stable components and the reflections within the corner cubes 24,27 and two of the reflections within the 'W' prism 26 are self-compensating for component tilt, ensuring that the reference beams 22,23 are not affected by such displacements, and in particular transverse displacements of components 24,26,27 which do not effect the main beam. Such displacements do not affect the main beam 14 because it does not traverse these components. If such displacements were present they would lead to uncompensated errors in the differential displacement measurement. The third reflection in the 'W' prism is from a surface which acts as a plane reference mirror effectively in contact with the mantlet 3. Similarly, the steering wedges 15*a*,15*b*,19*a*,19*b* and the weak focus adjustment lenses 16,20 (if present) in the path of the main beam 14 are very stable components ensuring that the main beam 14 is not affected by displacements which do not affect the reference beams 22,23.

All of the optical components of the AMRS system use glass types which have been chosen to compensate for changes in focus with ambient temperature, which changes arise mainly due to expansion of the chosen housing material. Precise focusing is necessary, when high accuracy is desired, to avoid errors due to the parallax effect caused by variable vignetting of the main beam 14 which may occur due to a large deflection of the beam by the muzzle mirror 5 and/or partial obscuration due to, for example, mud on the mirror 5 which is an external component. For the same reasons, the lens optical aberrations must be highly corrected across the aperture. These effects do not normally impact on the reference channels due to the fixed geometry of these channels.

Figure 3:
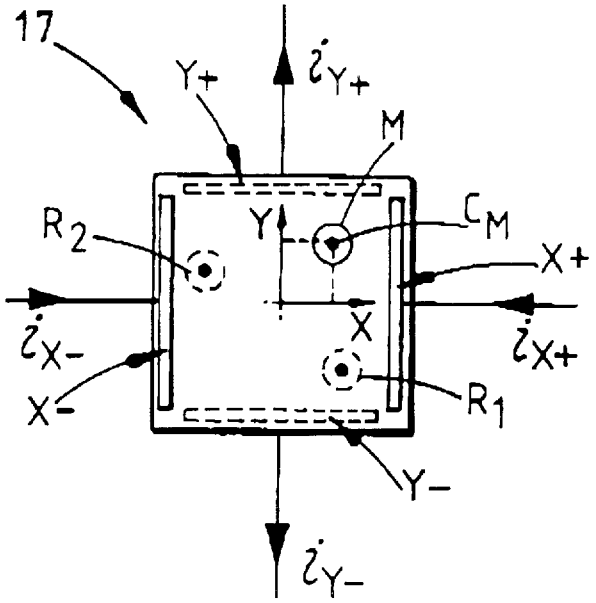
FIG. 3 shows a plan view of a photodetector of the system of FIGS. 1 and 2 showing the positions at which a main beam and two reference beams are incident.

There is shown in FIG. 3 a plan view of the preferred photodetector 17 of the AMRS system. The photodetector 17 for example is a lateral effect photodiode of the two-axis continuous type in which the signal photocurrent, which is proportional to the total signal power incident upon it, is distributed among two orthogonal pairs of signal terminals (denoted x+, x−, y+, y−) in a manner dependent upon the position of the centroid of the total incident energy. The terminals (x+, x− or y+, y−) are associated with positive and negative directions along respective orthogonal measurement axes x, y relative to the centre of the body of the photodetector.

The output signals of the four terminals of the photodetector 17 are combined by the evaluation means 18 (FIG. 2), which comprises a calculation or arithmetic unit and a data storage unit, to determine the position of the centroid of an incident light beam. For example, FIG. 3 shows the position of the centroid $C_M$ of a main beam spot M incident on the photodetector and also typical positions of the two reference beam spots and their respective centroids, generally labelled $R_1$ and $R_2$. With the origin of the xy co-ordinate system (as indicated in FIG. 3) being located at the centre of the photodetector 17, the x co-ordinate of any centroid is determined by the equation:

$$x=(i_{x+}-i_{x-})/(i_{x+}+i_{x-}) \quad (1)$$

and the y co-ordinate is determined by the equation:

$$y=(i_{y+}-i_{y-})/(i_{y+}+i_{y-}) \quad (2)$$

where $i_{x+}$, $i_{x-}$, $i_{y+}$ and $i_{y-}$ are the true signal currents, corrected for background illumination and dark current effects, output by the photodetector terminals and the subscripts indicate the particular photodetector terminal as described above. In this type of detector the entire photoelectrically generated current is $(i_{x+}+i_{x-})$ and this is equal to $(i_{y+}+i_{y-})$ but on the x-axis the location of the centroid determines the distribution of current between $i_{x+}$ and $i_{x-}$. Similarly for the y-axis and the currents $i_{y+}$ and $i_{y-}$. The denominators in equations (1) and (2) normalise the xy co-ordinates and substantially eliminate the effects of intensity variations in any light source 9,10,11.

Since the detector 17 responds only to the centroid of the total incident energy, it is necessary that two or more light source images are not present simultaneously on the detector. To this end, the sources 9,10,11 are illuminated sequentially, and individual synchronised measurements are made for each source following which the separate measurements are normalised using equations (1) and (2) above. A period with no source energised is also provided to allow compensations to be achieved as described below.

For high accuracy, it is important that the photo-currents used in equations 1 and 2, or the amplifier outputs which represent them, do not include contributions from background illumination, dark current, or from gain differences in respective photodetector terminal amplifiers (not shown in the Figures). It is usual to employ transimpedance preamplifiers which convert current directly into output voltage and which have low input and output impedances, with one or more subsequent amplification stages connected in cascade.

Slowly varying (relative to the measurement time period) background illumination and dark current are compensated for by taking two measurements, firstly: signal plus background and secondly: background only, and respectively subtracting the two sets of four currents to deduce the corrected signal currents alone. Alternatively, this compensation can be achieved by modulating the optical source with an ac signal such that demodulation of the detector output can be used to eliminate dc and slowly varying components.

For the highest accuracy, the measurement beam is electronically chopped at the source to enable two separate, synchronous, measurements to be made of signal plus background, and background alone. This significantly reduces errors due to relatively rapid background variations caused by external influences, for example windscreen wipers operating on the surface of the lenses 16,20, and it also gives more flexibility with regard to automatic adjustment of source brightness and/or amplifier gains.

The gains associated with the four respective photodetector outputs must be equal and may be matched by component tolerancing. For the highest accuracy however, the gains are calibrated by injecting identical calibration currents into each preamplifier in turn, and compensating the gains of individual amplifiers as often as is required to achieve high precision.

The impact of time variant residual errors in the system due, for example, to thermal instabilities in the electronic amplifiers, can be approximately described by a linear function of the general form:

$$X=A_x x+B_x \quad (3)$$

$$Y=A_y+B_y \quad (4)$$

where X, Y are true co-ordinates and x, y, are the co-ordinates as calculated from the actual spot position and the stored system calibration data, for a beam at any point on the detection surface, and $A_x$, $A_y$ and $B_x$, $B_y$ are slowing varying coefficients respectively representing scaling and offset errors arising along the x and y axes.

If the actual position co-ordinates of the reference beams R1, R2 at a datum time and the current time are respectively $(X_{R1}, Y_{R1})$, $(X_{R2}, Y_{R2})$ and $(x_{R1}, y_{R1})$, $(x_{R2}, y_{R2})$, where the datum time is the time when the system is calibrated and scaling and offset data are stored, these co-ordinates must also satisfy the linear relations given in equations (3), (4) above. Therefore, $X_{R1}=A_x\ x_{R1}+B_x$, ; $Y_{R1}=A_y\ y_{R1}+B_y$;

$X_{R2}=A_x\ x_{R2}+B_x$, ; and $Y_{R2}=A_y\ Y_{R2}+B_y$ so that $$A_x=(X_{R2}-X_{R1})/(x_{R2}-x_{R1}) \quad (5)$$

$$A_y=(Y_{R2}-Y_{R1})/(y_{R2}-y_{R1}) \quad (6)$$

$$B_x=X_{R1}-A_x\ x_{R1} \quad (7)$$

$$B_y-Y_{R1}-A_y\ Y_{R1} \quad (8)$$

It can be seen that, when the current time is the datum time (x=X, y=Y) the correction coefficients A and B are then unity and zero respectively. Also when both reference beams are displaced equally ($x_{R1}-X_{R1}=X_{R2}-X_{R2}$ and $y_{R1}-Y_{R1}=y_{R2}-Y_{R2}$) the coefficients A are always unity, and only the offset coefficients B change. Similarly when both reference beams move in proportion to their respective distances from the co-ordinate origin ($x_{R1}/X_{R1}=x_{R2}/X_{R2}$; $y_{R1}/Y_{R1}=y_{R2}/Y_{R2}$) then the coefficients $B_x$, $B_y$ are always zero and the scaling coefficients $A_x$, $A_y$ change.

The true co-ordinates $X_M$, $Y_M$ of the centroid $C_M$ of the main beam M can thus be found by substituting its actual position co-ordinates $X_M$, $y_M$, together with the most recently evaluated co-efficients $A_x$, $A_y$, $B_x$, $B_y$, into equations (3), (4) above.

The correction for offset applies whether the reference beam displacements arise due to component instability or due to movement of the prism 26 caused by displacement of the interface 28 to which it is mounted. This ensures that the system automatically corrects for motion of the interface 28 (the second object), effecting a differential measurement between it and the mirror 5 (mounted on the first object). Implementation of an arbitrary datum offset, for example a floating zero, is automatically achieved by quoting the required output value when carrying out the calibration procedure; this may be done at any time on demand.

In the simplest form of the present invention, only one of the reference beams 22,23 requires to be used to permit the evaluation means to calculate the displacement of the mirror 5 relative to the prism 26. This is achieved by assuming no change to the stored scaling data, and the coefficients $A_x$, $A_y$ are always unity. The remaining coefficients $B_x$, $B_y$ are then simply calculated from the equations (7), (8) above using the position data from only reference beam $R_1$, as often as is necessary. The actual co-ordinates of the main beam are then corrected as above for each measurement to give the true co-ordinates.

$$X_M = x_m + B_x$$

$$Y_M = y_M + B_y$$

In more complex form of the present invention, as illustrated in FIG. 2, both reference beams 22,23 are employed to enable an additional correction for scaling errors to be made. The four coefficients $A_x$, $A_y$, $B_x$, $B_y$ are then calculated from the equations (5), (6), (7), (8) above using the position data from both reference beams R1, R2 as often as is necessary. The actual co-ordinates of the main beam are then corrected as above for each measurement to give the true co-ordinates $$X_M = A_x X_M + B_x$$

$$Y_M = A_y y_M + B_y$$

In the above described AMRS system, it is of course necessary in a set-up mode to calibrate the overall sensitivities and to align the deflection co-ordinate system to some external reference. In the set-up mode the system accepts an externally applied deflection of known magnitude and direction to the main beam 14 as a definition of (say) the vertical axis. This may be achieved, for example, by the insertion of a small angle wedge (not shown), oriented in a known manner relative to the AMRS housing 7, into the path of the main beam 14. Additionally, a given muzzle mounted mirror position can be designated as an initial datum to which the subsequent output can be referenced, as described above. Prior art systems, which employ only a single main measurement channel to obtain a differential measurement with respect to their housings, can be calibrated for offset and sensitivity to provide an output which is accurate at the time of calibration but the effects of time, temperature, vibration, etc, cause the accuracy of the output to degrade progressively by an unknown amount, necessitating frequent re-calibration to maintain high accuracy. The present invention, by the provision of one, or more, reference channels, continuously tracks, and compensates for, departures in system alignment from the most recent calibration, and very substantially extends the interval required between re-calibrations in order to achieve a given level of accuracy.

The transmit and receive channels are each equipped with as set of steering wedges 15*a*,15*b*,19*a*,19*b* as described above in order to allow the outgoing beam and the detector field of view to be aimed at the muzzle mounted mirror 5. It will of course be understood that the transmit and receive apertures are symmetrically disposed about an axis perpendicular to the reflecting surface of the mirror 5 and passing through its centre to comply with the laws of reflection. This can be achieved either by translating the AMRS housing 7 or by tilting the muzzle mounted mirror 5. These alignment tasks can be greatly simplified by rendering the main beam visible, either by using visible light or by using infrared light and viewing this light with an appropriately sensitive viewing device. Alternatively, a special purpose beam locator, employing synchronous detection, can be used especially when the background level is too high to enable the light to be viewed directly.

It will be appreciated that for covertness in military applications non-visible radiation of the lowest practical intensity is advantageous. To this end, the AMRS system 4 employs near infra-red radiation and adjusts the intensity according to the level of the background measured at the detector. The sources 9,10,11 can of course be switched off when measurement is not required, for example only being activated for a short period immediately prior to firing of the gun.

If required, the output position $C_M$ can be further offset by the initial datum position stored during the set-up procedure. The aiming computer then determines, from the (compensated) AMRS system output, a correction factor which can be used to more accurately aim the barrel 1. With a suitable frequency response from the signal processing electronics, the improvement in aimpoint can also be extended to correct for dynamic flexure of the barrel caused when the tank is moving over uneven terrain of event for movements of the barrel 1 occurring during firing of the gun.

Modifications may be made to the above described embodiment without departing from the scope of the invention. For example, the light sources 9, 10, 11 may operate in any suitable frequency range such as visible, UV or IR. The 'W' reference prism 26 could be mounted internally on the rear wall of the AMRS housing 7 which would then be securely attached to the gun mantlet 3, thus avoiding the requirement for the window 25.

The degree of collimation of the main beam 14 at the muzzle mounted mirror 5 may be modified by adjusting the power of, or by omitting, the focusing lenses 20, 16 at the transmit and receive apertures and/or by providing a curved surface on the muzzle mirror, to change the displacement characteristics, eg as regards sensitivity and vignetting. Furthermore, when the mirror 5 has a curved surface the detection arrangement becomes sensitive to transverse linear displacement of the mirror as well as angular displacement. The use of non-collimated light in the region of the mirror 5 reduces the system sensitivity, and the angular measurement range achieved before the outset of severe vignetting is increased. However, the detector arrangement then also becomes sensitive to longitudinal movement of the mirror 5.

The cross-sectional area of the main beam, and if necessary the reference beams 22,23 may be relatively large, eg 50 mm in diameter, in order to average out the effects of rain drops and dust particles in the transmission path(s). Space may be saved by combining the transmit and receive optics through a common aperture and through common components using a beamsplitter.

Figure 4:
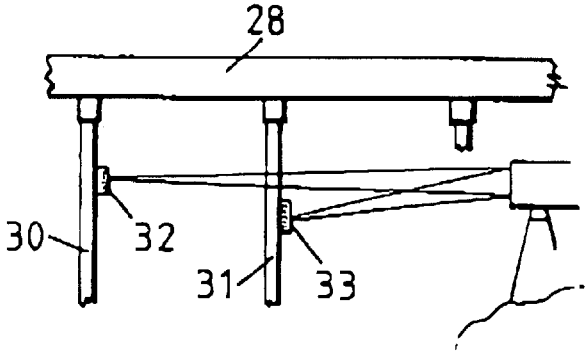
FIG. 4 shows a displacement reference system for use in detecting movement of a bridge structure.

The invention is applicable to fields other than AMRS systems where it is required to accurately measure the relative displacement of two objects. For example, there is shown in FIG. 4 a part of a bridge 28, carried on ground-mounted supports 30,31, the stability of which is to be measured. The supports are equipped with reflectors 32,33 which are monitored remotely by a displacement measurement apparatus 34 shown mounted on a tripod 35. The tripod may be mounted anywhere and need not be stable to a high order of accuracy since any movement thereof will affect equally the measurements made from the reflectors 32,33 and will not influence the calculation of their relative movement. The apparatus 34 forms the datum for the system in a manner similar to the housing 7 of FIG. 2.

Figure 5:
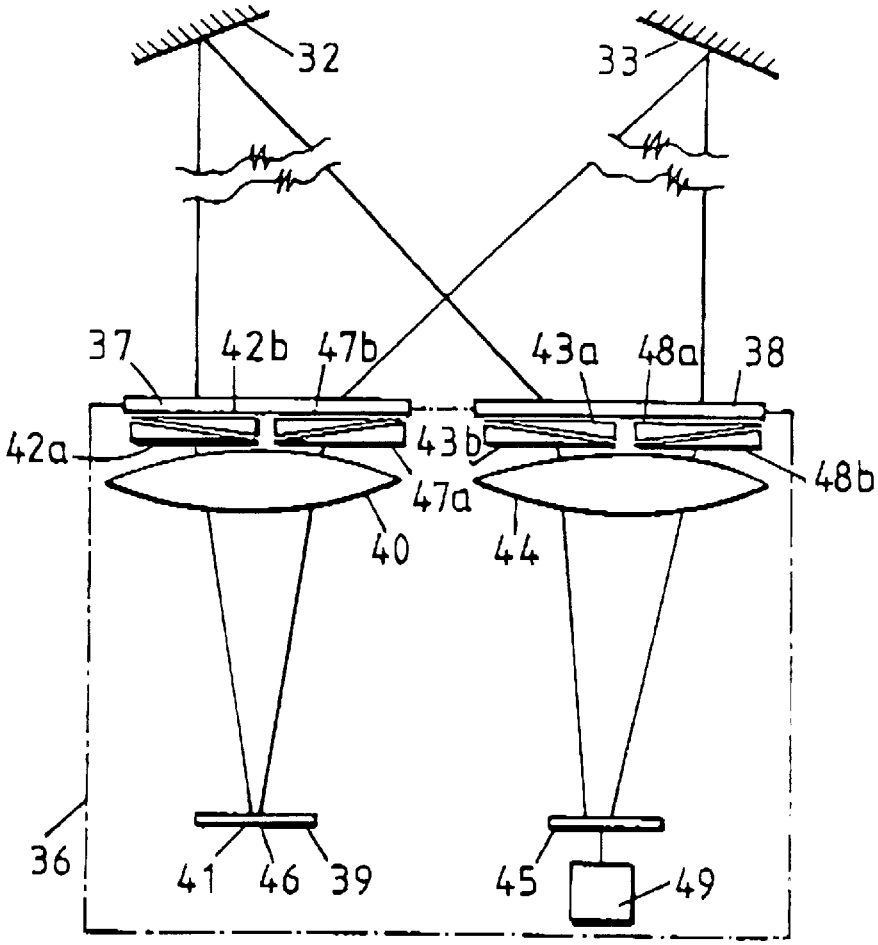
FIG. 5 shows in detail the optical components of the system of FIG. 4.

FIG. 5 shows in more detail the optical components which comprise the displacement measurement apparatus 34 of FIG. 4 (again the diagram is compressed in the longitudinal direction for clarity). The active components of the system are contained inside a protective housing 36 fitted with suitable windows 37,38. These active components are in turn rigidly secured within the housing 36 to sensibly minimise errors arising from vibration and relative movement.

The housing 36 contains an illuminated source object 39 in the focal plane of a collimating lens 40. A region of the source object containing a first identifiable marking 41 is projected by the collimating lens 40 and directed by a pair of adjustable steering wedges 42*a*,42*b* so as to be incident on the plane mirror 32 mounted on the first remote bridge support 30. The beam is reflected by the bridge mounted mirror 32 and returns towards the displacement measurement apparatus housing 34. The reflected beam passes through a receiving pair of steering wedges 43*a*,43*b*, and a lens 44 which focuses the beam to give a sharp image of the mark 41 on the sensitive detection surface of a TV camera 45.

A second region of the source object 39 containing a second identifiable marking 46 is similarly directed to the second plane mirror 33 mounted on the second remote bridge support 31 by means of the same collimating lens 40 and a second pair of steering wedges 47*a*,47*b*. A second receiving pair of steering wedges 48*a*,48*b* and the same receiving lens 44 form a sharp image of the second mark 46 on the TV camera 45. An evaluation means 49 is connected to the TV camera output.

It will be appreciated from FIGS. 4 and 5, that any displacement of either mirror 32,33 will cause the image of the corresponding source object mark 41,46 focused onto the TV camera 45 to move across the camera surface and, if the displacement of the mirror is great enough, to move off the surface of the camera. The nature of the identifiable marks 41,46 is chosen so that they can be individually located in the output TV image by a readily available automatic classification and tracking system connected to the video output, for example one mark could be a circle and the other mark could be a cross. The output from such a tracking system, which forms part of the evaluation means 49 having a storage unit and an arithmetic unit, is an (x,y) position co-ordinate for each of the marks. By subtracting the positions of the first and second mark images, the relative motion of the two mirrors 32,33 and their respective bridge supports 30,31 can be deduced. The measurement sensitivity of the two channels can be established by temporarily inserting a wedge of known deviation into each channel and recording the corresponding image co-ordinate changes. Only the sets of steering wedges 42*a*,42*b*,47*a*,47*b*, 43*b*,48*a*,48*b* are not common to both channels, but these components can be successfully mounted with a high degree of stability. All other instabilities affect both channels equally and are thus compensated for when the relative movement of the two mirrors is finally obtained by subtraction. The second measurement channel in this embodiment is performing the same function as the first reference channel of the embodiment in FIG. 2.

What is claimed is:

1. Apparatus for measuring the displacement of a first object (6) relative to a second object (28), the apparatus comprising:

first and second reflection means (5,26) respectively fixed to the first and second objects (6,28), electromagnetic radiation source means comprising a plurality of discrete sources (9,10,11), electromagnetic radiation detection means (17), means forming a first channel (13,15*a*,15*b*,16,20,19*a*,19*b*, 21) for directing a first beam of radiation from the source means (9) onto the first reflection means (5) and for directing the reflected beam onto the detection means (17), means forming a second channel (13,24,26,27,21) for directing a second and a third beams of radiation from the source means (10,11) onto the second reflection means (26) and for directing the respective reflected beams onto the detection means (17), the second and third beams being arranged to be incident upon the surface of the detection means (17) at nominally fixed, spaced apart locations, wherein the first and second channels comprise common optical components (13,21) which are traversed by each of said first, second and third beams, the detection means (17) comprising an electro-optic detection surface arranged to provide electrical signals indicative of the positions on the detection surface where the reflected beams of the first and second channels are incident, and evaluation means (18) coupled to receive said signals and by:

(i) differential measurement between the signals provided by the first and second beams to calculate therefrom a measure of the displacement of the first object (6) relative to the second object (28), and:

(ii) by differential measurement between the signals provided by the second and third beams to calculate a compensation factor for variations from an initial value of the gain or sensitivity of the detection means (17) and the powered optical components in the second channel (13,24,26,27,21).

2. Apparatus as claimed in claim 1, wherein the detection means (17) comprises a lateral effect photodiode arranged to determine the position of the centroid of an incident radiation beam, the source means (9,10) are arranged sequentially to generate the first and second beams, and the evaluation means (18) comprises a data storage unit and a calculation or arithmetic unit.

3. Apparatus as claimed in claim 1, wherein the detection means (17) comprises a TV camera which records the position of the or each incident light beam, and the evaluation means (18) comprises a storage unit, an automatic classification and tracking system, and a calculation or arithmetic unit.

4. Apparatus as claimed in any preceding claim, wherein the common optical components (13,21) of the first and second channels are optically powered and position sensitive and each said channel has further optical components (15, 16,24,27,20,19) which are substantially stable and position insensitive.

* * * * *

UNITED STATES PATENT AND TRADEMARK OFFICE

CERTIFICATE OF CORRECTION

PATENT NO. : 5,883,719

DATED : March 16, 1999

INVENTOR(S) : Coope

It is certified that error appears in the above-identified patent and that said Letters Patent is hereby corrected as shown below:

On the title page item [30],

In the Foreign Application Priority Data, "950348506" should read --9503485.6--.

In the Abstract, last line, after "measurement" insert a period (.).

Column 12, line 50, "any preceding claim" should read --claim 1--.

Signed and Sealed this

Seventeenth Day of August, 1999

*Attest:*

Q. TODD DICKINSON

*Attesting Officer*

*Acting Commissioner of Patents and Trademarks*